US008178768B1

(12) United States Patent
Shepherd

(10) Patent No.: US 8,178,768 B1
(45) Date of Patent: May 15, 2012

(54) DRUM RIM RAISING APPARATUS WITH TRIGGERING SYSTEM

(76) Inventor: James Frederick Shepherd, Woodside, NY (US)

( * ) Notice: Subject to any disclaimer, the term of this patent is extended or adjusted under 35 U.S.C. 154(b) by 0 days.

(21) Appl. No.: 12/831,243

(22) Filed: Jul. 6, 2010

Related U.S. Application Data

(63) Continuation-in-part of application No. 11/055,250, filed on May 16, 2005, now Pat. No. 7,772,473.

(51) Int. Cl.
*G10D 13/02* (2006.01)

(52) U.S. Cl. ..... 84/411 R; 84/421

(58) Field of Classification Search ..... 84/411 R, 84/421
See application file for complete search history.

(56) References Cited

U.S. PATENT DOCUMENTS 7,723,592 B1 * 5/2010 Dixson, Jr. ..... 84/411 R
* cited by examiner

*Primary Examiner* — Kimberly Lockett
(74) *Attorney, Agent, or Firm* — Michael D. Eisenberg

(57) ABSTRACT

A drum rim raising device that is attachable to an existing drum structure, comprising an arc section of a drum rim configured to be secured to the existing drum housing. The rim raising device is configured to support a triggering system.

19 Claims, 3 Drawing Sheets

DRUM RIM RAISING APPARATUS WITH TRIGGERING SYSTEM

CROSS-REFERENCES TO RELATED APPLICATIONS

The present application is a continuation in part of U.S. application Ser. No. 11/055,250 filed May 16, 2005 now U.S. Pat. No. 7,772,473 which is hereby incorporated herein by reference in its entirety.

TECHNICAL FIELD

The present invention relates to a drum rim rising device and some embodiments relate to a drum having a raised arc section of a drum rim.

BACKGROUND OF THE INVENTION

This invention relates to the need for accurate and consistent cross-stick playing, and, also addresses limitations in controlled acoustical sounds related to rim playing. This is due in part to the impossibility of a good grip on the drumstick. More particularly, it concerns an easily attachable, rim raising device that allows for a controlled accurate swing due to the allowance of a firmer grip on the drumstick.

Different drums have different acoustical properties, thus dramatically changing the cross stick sound, also, drum rims are very close to the playable drum head. The action of the drummer playing the head of the drum and switching to a cross stick sound requires a considerable amount of effort with very limited control. In the field of

BRIEF SUMMARY OF EMBODIMENTS OF THE INVENTION

It is the object of the invention to provide a solution to the problems described above. As will be seen, this device can be used in such a manner, as to further articulate cross stick playing, as well as enhance other areas of rim playing. With increased agility available to the player it opens up new acoustical possibilities.

A rim raising device is attachable to a drum, and includes:

A) A section of hard steel or hard synthetic material, solid or hallowed out, following the primary curvature of the arcuate rim, above the drum.

B) A mounting system, in which the presented device, fits onto the existing tension rods of a drum, and, is equipped with screws that tighten into threaded spacers. The device is held securely in place through its own torque.

As will be shown, another object is to provide the device as a molded configuration, with a section of the hoop sloping upward flattening out then descending, providing added cross stick playing space.

In another variant, the rim raising device includes a triggering system.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
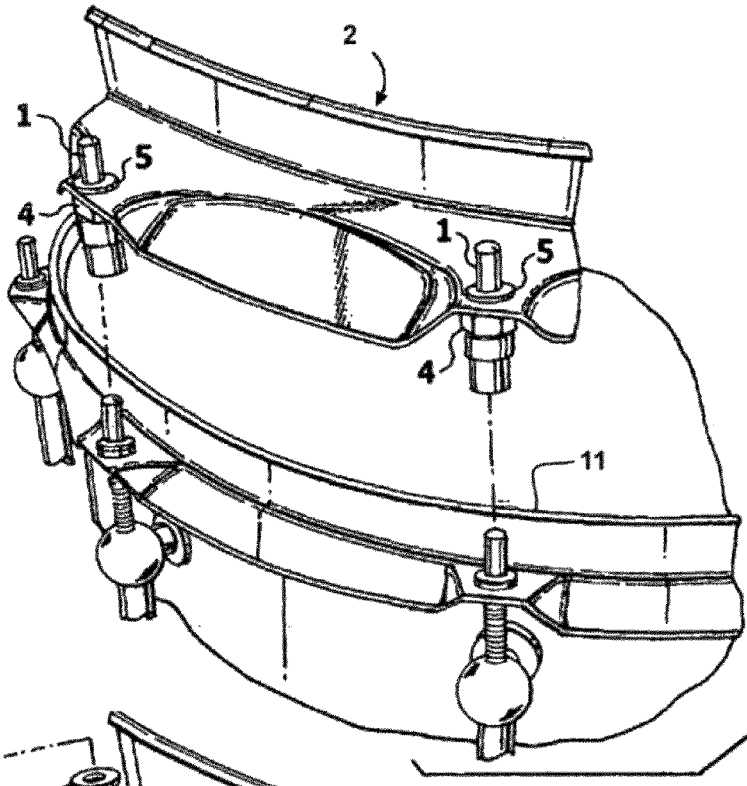
FIG. 1 is a fragmented view of a drum and one embodiment of the Rim Raising device.

Referring to FIG. 1, the rim raising device 2 may be primarily comprised of hard steel, wood or a hardened synthetic material with curvature in the arcuate direction above the drum 11 the attachment system is of a threaded material fitting onto the existing tuning rods of a drum 4 with tightening screws 1 and locking washers 5. The device is secured through its own torque onto the drum.

Figure 2:
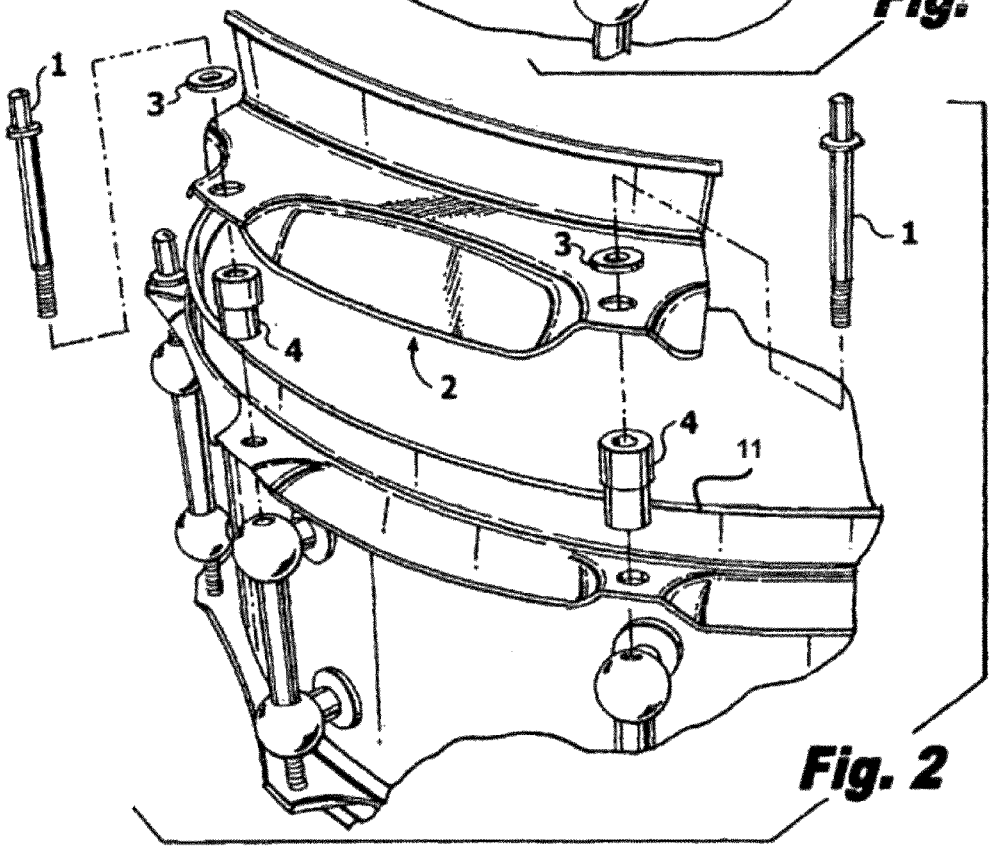
FIG. 2 is a perspective view of the drum of FIG. 1 of a different embodiment of the invention.

Referring to FIG. 2, the rim raising device 2 is comprised of the same materials as in FIG. 1, and the device may 2 attach by way of spacers 4. The device is flanged to align with the existing flanges on the drum's rim and extended tension rods 1 hold the device securely. Washers 3 are added to ensure stability.

Figure 3:
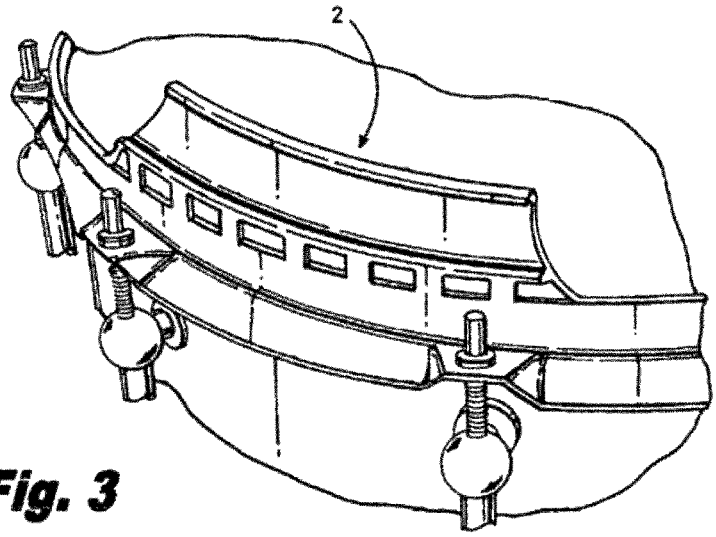
FIG. 3 is a pre-molded embodiment as part of the existing drum rim.

FIG. 3 illustrates a pre-molded configuration 1. The rim raising device is one complete unit with drum's rim.

Figure 4:
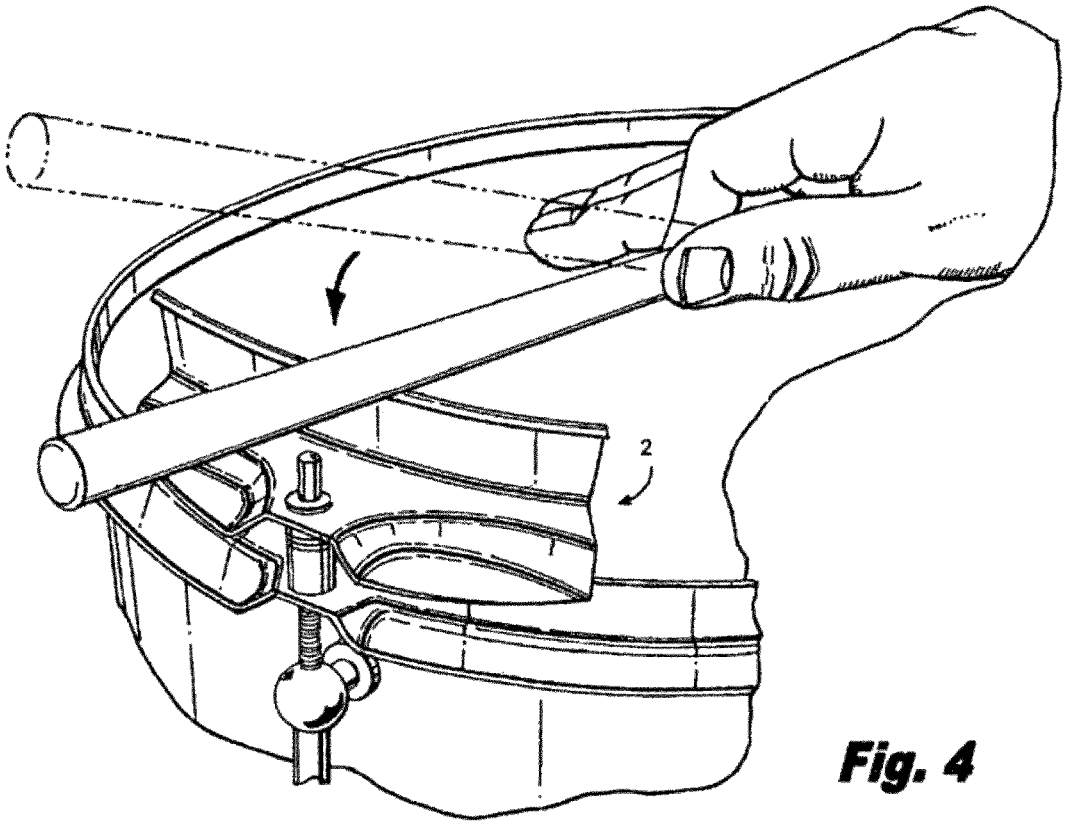
FIG. 4 illustrates one aspect in which an embodiment of the invention is applied (fitted for a singular tension rod)

Referring to FIG. 4, the Rim Raising device is comprised of the same materials and would typically be a length of two to nine inches in length. As previously mentioned may also attach to a singular extended tension rod 1 and one spacer. The device is flanged to align with existing flange on the drum's rim. This illustration also demonstrates one advantageous way the invention works. The user is given more space between the drum's rim and the playable drum head for added agility.

Figure 5:
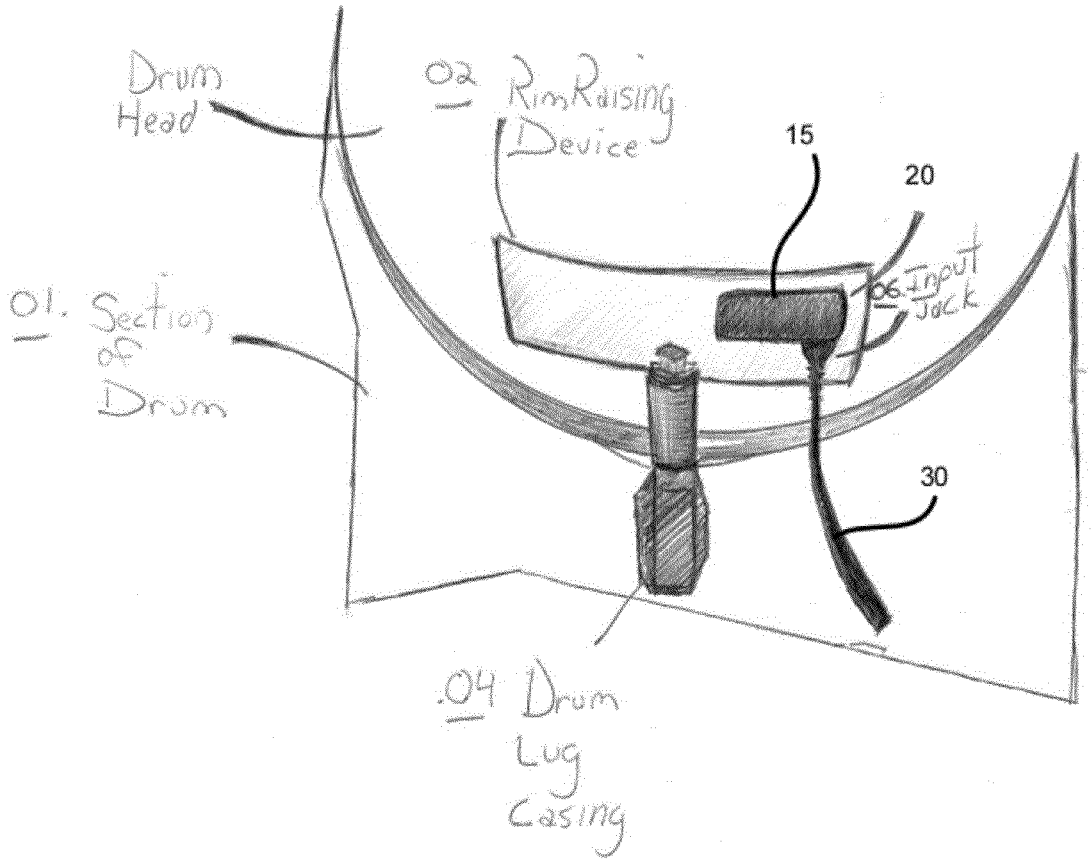
FIG. 5 illustrates a triggering system.

Referring to FIG. 5, the rim raising device may be configured to support a triggering system 15. Illustrated in FIG. 5 is a section of a drum, a drum head, a rim raising device 2 connected to the drum via a drum lug casing. The triggering system may be comprised of a piezoelectric element 20 and an input jack 6 for receipt of a cord 30 for connection to a sounds system. In one variant, the triggering system 15 attaches to a side wall of the rim raising device. When the rim raising device is struck by a drum stick, the triggering system will trigger the sounding of a predetermined sound. In one variant, the side wall of the rim raising device has a hole for passing wire of the triggering system therethrough or attaching the triggering system to the rim raising device. In one advantage, the placement of the triggering system could preclude the need for electronic pads.

While various embodiments of the present invention have been described above, it should be understood that they have been presented by way of example only, and not of limitation Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A drum rim raising device that is attachable to an existing drum structure having flanges, comprising:

an arc section of a drum rim configured to be secured to the existing drum structure;

wherein the arc section of a drum rim comprises a side wall and a top edge, the side wall configured to elevate the top edge over the drum rim circumference of an existing drum rim and is disposed between the drum rim circumference and the top edge when the drum rim raising device is attached to the existing drum structure;

wherein the top edge of the arc section is spaced apart vertically above the existing rim structure when the drum rim raising device is attached to the existing drum structure; and wherein the drum rim raising device is flanged to align with the existing flanges on the drum rim;

wherein the drum rim raising device is configured to replace the corresponding arc section of the existing drum rim such that when the drum rim raising device is attached to the existing drum rim, the drum and rim raising device comprise an assembly for allowing a drummer to maintain a more comfortable and natural grip on a drum stick when cross-sticking is performed on the drum rim;

wherein the rim raising device is configured to support a triggering system.

2. The drum rim raising device of claim 1, further comprising a triggering system connected to the sidewall of the rim raising device.

3. The drum rim raising device of claim 2, wherein the triggering system comprises a piezoelectric element and an input jack.

4. The drum rim raising device of claim 2, wherein the sidewall comprises a hole.

5. The drum rim raising device of claim 1 comprised of hardened steel and is attached by a clamp or clamps.

6. The drum rim raising device of claim 1, further comprising a threaded spacer for attaching the device and tightening it onto drum's existing tension rods.

7. The drum rim raising device of claim 1 replacing the existing tension rods on the drum.

8. The drum rim raising device of claim 1 wherein the rim raising device is comprised of a solid wood block that is connected to the drum via at least one clamp.

9. The drum rim raising device of claim 1 wherein the rim raising device is comprised of a durable plastic piece that is screwed into at least one existing tension rod of the drum.

10. The drum rim raising device claim 1 wherein the rim raising device is comprised of a durable plastic piece that is connected to the drum with at least one extended tension rod.

11. The drum rim raising device claim 1 wherein the arc section of a drum rim is configured to form an air space between the arc section and the existing drum rim when the arc section is attached to the existing drum rim.

12. The drum rim raising device of claim 1, wherein the rim raising device comprises 95% or less of the circumference of the drum rim.

13. The drum rim raising device of claim 1, further comprising air spaces disposed within the rim raising device.

14. A drum rim raising device that is attachable to an existing drum structure having flanges, comprising:

an existing drum rim having a conventional height extending from a drum head;

an arc section of a drum rim configured to be secured to the existing drum structure;

wherein the arc section of a drum rim comprises a side wall and a top edge, the side wall configured to elevate the top edge directly above an existing drum rim a distance greater than or equal to the height of the drum rim itself; and wherein the drum rim raising device is flanged to align with the existing flanges on the drum rim;

wherein the rim raising device is configured to support a triggering system;

wherein the drum rim raising device is configured replace the corresponding arc section of the existing drum rim such that when the drum rim raising device is attached to the existing drum rim, the drum rim raising allows a drummer to maintain a more comfortable and natural grip on a drum stick when used on the drum rim raising device for cross-sticking.

15. The drum rim raising device of claim 14, wherein the arc section has a curvature that matches the existing drum rim.

16. The drum rim raising device of claim 14, wherein the arc section is configured to be disposed somewhere in a volume bounded by an area projected upward 90 degrees from the outer perimeter of the drum.

17. The drum rim raising device of claim 14, wherein the drum rim raising device is configured for attachment to an existing drum rim such that a bottom edge of the drum rim raising device is spaced apart from and above the drum rim.

18. The drum rim raising device of claim 1, wherein the drum rim raising device is configured for attachment to an existing drum rim such that a bottom edge of the drum rim raising device is spaced apart from and above the drum rim.

19. A drum rim raising device attachable to an existing drum structure, comprising:

an arc section of a drum rim configured to be secured to the existing drum structure;

wherein the arc section of a drum rim comprises a side wall and a top edge, the side wall configured to elevate the top edge above an existing drum rim and form an air space between the arc section and the existing drum rim when attached to the existing drum structure; and wherein the drum rim raising device is configured such that when the drum rim raising device is attached to the existing drum rim, the drum and rim raising device comprise an assembly for allowing a drummer to maintain a more comfortable and natural grip on a drum stick when cross-sticking on the drum rim raising device.

* * * * *